US005905483A

United States Patent [19]

Yuki

[11] Patent Number: 5,905,483

[45] Date of Patent: May 18, 1999

[54] DISPLAY CONTROL APPARATUS

[75] Inventor: Osamu Yuki, Atsugi, Japan

[73] Assignee: Canon Kabushiki Kaisha, Tokyo, Japan

[21] Appl. No.: 08/010,439

[22] Filed: Jan. 28, 1993

[30] Foreign Application Priority Data

Jan. 30, 1992 [JP] Japan ..... 4-040271

[51] Int. Cl.[6] ..... G09G 3/36

[52] U.S. Cl. ..... 345/98; 345/97; 345/204; 345/508

[58] Field of Search ..... 340/784, 717, 340/799, 750, 771, 723; 345/87, 97, 1, 123, 3, 195, 185, 189, 190, 132, 213, 98, 99, 100, 60, 124, 204, 507, 516, 508, 511

[56] References Cited

U.S. PATENT DOCUMENTS

| | | | |
|---|---|---|---|
| 4,451,824 | 5/1984 | Thayer et al. | 345/141 |
| 4,661,812 | 4/1987 | Ikeda | 340/799 |
| 4,694,288 | 9/1987 | Harada | 345/120 |
| 4,713,779 | 12/1987 | Graciotti et al. | 345/185 |
| 4,730,186 | 3/1988 | Koga et al. | 345/123 |
| 4,747,042 | 5/1988 | Ishii et al. | 345/200 |
| 4,864,518 | 9/1989 | Kurita | 340/750 |
| 4,884,069 | 11/1989 | Farand | 345/190 |
| 5,091,723 | 2/1992 | Kanno et al. | 340/811 |
| 5,093,807 | 3/1992 | Hashimoto et al. | 365/230.09 |
| 5,218,274 | 6/1993 | Zenda | 340/717 |
| 5,268,682 | 12/1993 | Yang et al. | 345/200 |
| 5,353,041 | 10/1994 | Miyamoto et al. | 345/100 |
| 5,357,267 | 10/1994 | Inoue | 345/201 |

FOREIGN PATENT DOCUMENTS

| | | | |
|---|---|---|---|
| 0265643 | 5/1988 | European Pat. Off. | 345/201 |
| 0318050 | 5/1989 | European Pat. Off. . | |
| 03098088 | 4/1991 | Japan | 345/185 |

*Primary Examiner*—Lun-Yi Lao

*Attorney, Agent, or Firm*—Fitzpatrick, Cella, Harper & Scinto

[57] ABSTRACT

The invention intends to provide a display control apparatus which can perform the flickerless display at a high precision without changing a construction of the electrodes or the like of a display apparatus even when a display speed in the high precision display of a liquid crystal display apparatus is insufficient for the flickerless display in the non-interlace drawing. The display control apparatus 50 has a VRAM and a partial rewrite display control section. Since a WS (host computer) 1 prevents a flicker of the display in the animation image display, for an object which is drawn at a high speed, when image data stored in the VRAM is partially rewritten by the non-interlace, the partial rewrite display control section adds data indicative of the display position of the portion rewritten by the WS 1 to the image data and sync signal of such a rewritten portion and, after that, supplies the image data to a liquid crystal display apparatus 3 at the timing synchronized with the display to the CRT.

18 Claims, 12 Drawing Sheets

| FIG. 2A | FIG. 2B | FIG. 2C |
|---|---|---|

FIG. 10

| SYMBOL | DESCRIPTION | FUNCTION |
|---|---|---|
| PGOOD | POWER ON | +5V LINE |
| FCLK | IMAGE DATA TRANSFER CLOCK | IMAGE DATA TRANSFER CLOCK (VARIOUS FOR MODE) |
| FHSYNC | HORIZONTAL SYNC. SIGNAL | HORIZONTAL SYNC. SIGNAL AFTER SKEW |
| FVSYNC | VERTICAL SYNC. SIGNAL | VERTICAL SYNC. SIGNAL AFTER SKEW |
| FDISP | COMPOSIT BLANK | COMPOSIT BLANK SIGNAL AFTER SKEW |
| SIN | INPUT DATA | INPUT OF COMMUNICATION DATA |
| SOUT | OUTPUT DATA | OUTPUT OF COMMUNICATION DATA |
| BUSY | EXTERNAL HOR. SYNC. SIG. SYNC. | SYNC. SIGNAL UPON PARTIAL WRITE |
| AH/DH | ADDRESS/DATA DISCRIMINATION | ADDRESS/DATA DISCRIMINATION UPON PARTIAL WRITE |
| PH/RL | REFRESH/PARTIAL WRITE | REFRESH/PARTIAL WRITE STATUS |
| CREF | FORCED REFRESH SIGNAL | FLC FORCED REFRESH SIGNAL (NEGATIVE LOGIC) |
| FINT | CONTROLLER INTR SIGNAL | ACKNOWLEDGE SIGNAL FROM CONTROLLER |
| GINT | GRAPHIC INTR SIGNAL | INTR SIGNAL FROM GRAPHIC |
| PD0-15 | ADDRESS/DATA LINE | ① UPON REFRESH → 16 BIT DATA |
| | | ② UPON PARTIAL WRITE → 16 BIT DATA |
| | | AH/DL(HI) → ADDRESS |
| | | AH/DL(LOW) → DATA |
| CBOD | FORCED BORDER SIGNAL | FORCED BORDER SIGNAL (NEGATIVE LOGIC) |
| GRST | GRAPHIC RESET | GRAPHIC ADAPTOR RESET |
| FRST | CONTROLLER RESET | DISPLAY CONTROLLER RESET |
| GND | GROUND | COMMON GROUND |

DISPLAY CONTROL APPARATUS

BACKGROUND OF THE INVENTION

1. Field of the Invention

The present invention relates to a display control apparatus for a liquid crystal display apparatus.

2. Related Background Art

Hitherto, a cold cathode ray tube display apparatus (hereinafter, abbreviated to "CRT") has generally been used as a display apparatus which is applied to a personal computer (hereinafter, abbreviated to "PC") or a work station (hereinafter, abbreviated to "WS"). To improve the understanding by the sense of sight on the basis of the human engineering, the graphic function such as a window function or the like is expanded. A high resolution and a large display screen are needed to realize such an expanded graphic function.

On the other hand, in recent years, a liquid crystal display apparatus (hereinafter, also abbreviated to "LCD") having a TN (Twisted Nematic) or STN (Super Twisted Nematic) structure or the like has been used in a lap-top type PC or the like due to predominance of light weight and thin size according to its construction. As for the LCD having such a TN or STN structure or the like, in the case where the number of scan lines is increased to realize a high resolution, a liquid crystal material having sharp electro/optical characteristics is needed to assure a margin of a display contrast. A ferroelectric liquid crystal having bistability is known as a liquid crystal material of such an LCD.

In case of the ferroelectric liquid crystal (FLC) which is known at present, when an operation temperature is low, a flickering occurs due to its temperature characteristic because the FLC doesn't have enough high display speed in a high precision display mode. To prevent the flicking, a method of drawing by a high-order interlace (hereinafter, referred to as "multi-interlace") is known.

According to the multi-interlace drawing, when an anti-mation image is displayed, a flicker occurs in display modes such as pointing device, pop-up menu, scroll, and the like and a display quality is deteriorated. Therefore, to prevent such flicker of the display, a method of partially rewriting a picture plane by a non-interlace for an object which is drawn at a high speed is known.

The above partial writing method, however, is realized by using special hardware and software which are used only for the LCD. Therefore, hitherto, a display control apparatus for the LCD is installed on a mother board or an expansion slot of a host computer and is directly coupled to an address bus, a data bus, and a control signal line of a central processing unit (hereinafter, abbreviated to "CPU") of the host computer and needs a special software driver which is used only for the LCD.

As mentioned above, the display control apparatus for the conventional LCD has a problem such that it needs the special software driver.

SUMMARY OF THE INVENTION

The present invention, therefore, is made in consideration of the above problems and it is an object of the invention is to provide a display control apparatus in which even in the case where a display speed in the high precision display mode of a liquid crystal display apparatus is insufficient for a flickerless display in the non-interlace drawing, the flickerless display can be executed at a high precision without changing a construction of electrodes or the like of the display apparatus.

To accomplish the above object, according to the present invention, there is provided a display control apparatus in which image data generated from a host computer is stored into a video memory and the image data is display on a liquid crystal display apparatus by a raster scan method, wherein the display control apparatus has a partial rewrite display control section which is constructed in a manner such that in the image data stored in the video memory, data indicative of the display position of a portion which has been rewritten by the host computer by a non-interlace method is added to the image data and a sync signal in the rewritten portion, and after that, the resultant image data is supplied to the liquid crystal display apparatus at a timing synchronized with the display to a cold cathode ray tube display apparatus.

With the above construction, in order to prevent the flicker of the display in the animation image display, when the host computer partially rewrites the image data stored in the video memory by the non-interlace method for an object to be drawn at a high speed, the partial rewrite display control section adds the data indicative of the display position of the rewritten portion to the image data and sync signal of the portion rewritten by the host computer and, after that, supplies the resultant image data to the liquid crystal display apparatus at a timing synchronized with the display to the cold cathode ray tube display apparatus. Due to this, even in the case where a display speed in the high precision display mode of the LCD is insufficient for the flickerless display in the non-interlace drawing, the flickerless display can be executed at a high precision without changing a construction of electrodes or the like of the display apparatus.

According to the invention disclosed in claim 1, there is provided a display control apparatus which supplies data indicative of the display position, image data, and sync signal to the LCD for a drawing period of time and a vertical blanking period of time of an effective display region of the cold CRT.

With the above construction, the data indicative of the display position of the rewritten portion, image data, and sync signal can be supplied to the LCD for the drawing period of time and vertical blanking period of time of the effective display region of the cold CRT, so that the image data can be smoothly drawn by the LCD.

BRIEF DESCRIPTION OF THE DRAWINGS

FIG. 10 is a table from explaining the functions of symbols which are used in the display control apparatus of the embodiment of the invention.

DETAILED DESCRIPTION OF THE PREFERRED EMBODIMENTS

An embodiment of the present invention will be described in detail hereinbelow with reference to the drawings.

Figure 1:
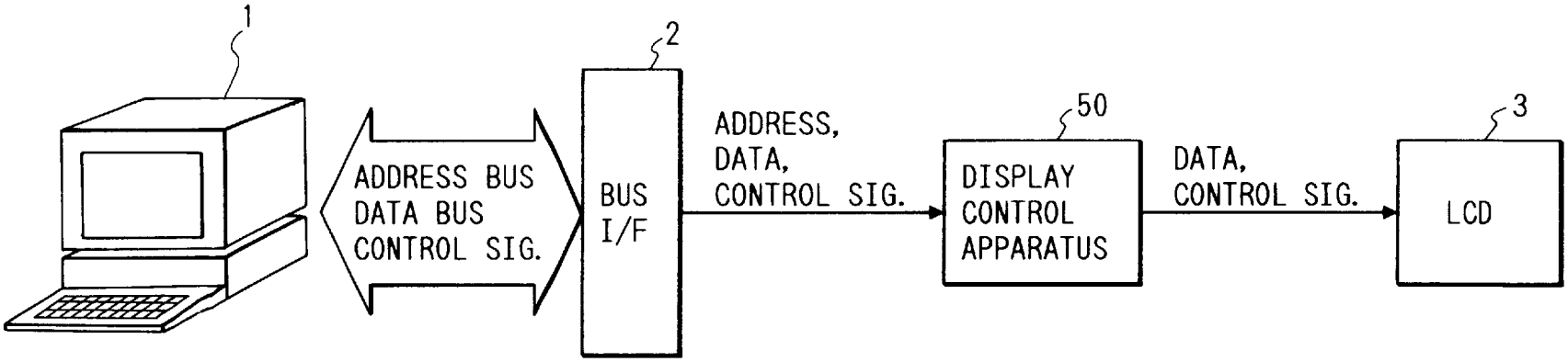
FIG. 1 is a constructional diagram of a display system showing an application example of a display control apparatus according to an embodiment of the present invention.

FIG. 1 is a constructional diagram of a display system showing an application example of a display control apparatus 50 according to an embodiment of the present invention. In the display system shown in FIG. 1, the display control apparatus 50 is connected through a bus interface 2 to a work station (hereinafter, abbreviated to "WS") 1 as a host computer. A liquid crystal display apparatus (also referred to as an LCD hereinafter) 3 is connected to the display control apparatus 50.

The WS 1 has an expansion slot and supplies address information, image data, and control signals to the bus interface 2 from a CPU (central processing unit) in the WS 1.

The bus interface 2 comprises: a decoder which has conventionally been used as an interface with the WS 1 and a CRTC (GSP) 58 in the display control apparatus 50, which will be explained hereinlater; a data transceiver; and the like.

Figures 2, 2A:
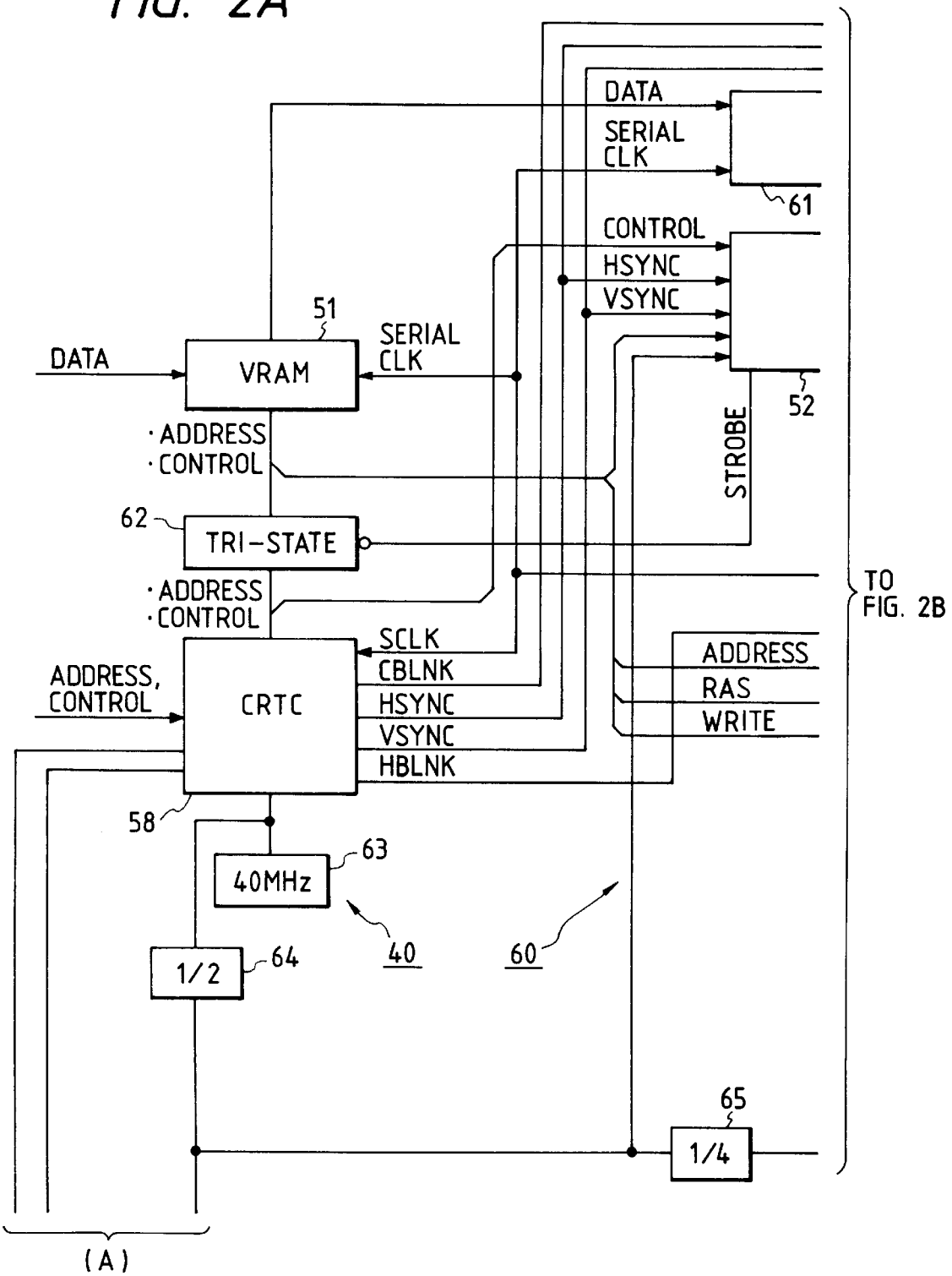
FIGS. 2A–C are a schematic constructional diagram of the display control apparatus of the embodiment of the invention.
Figure 2B:
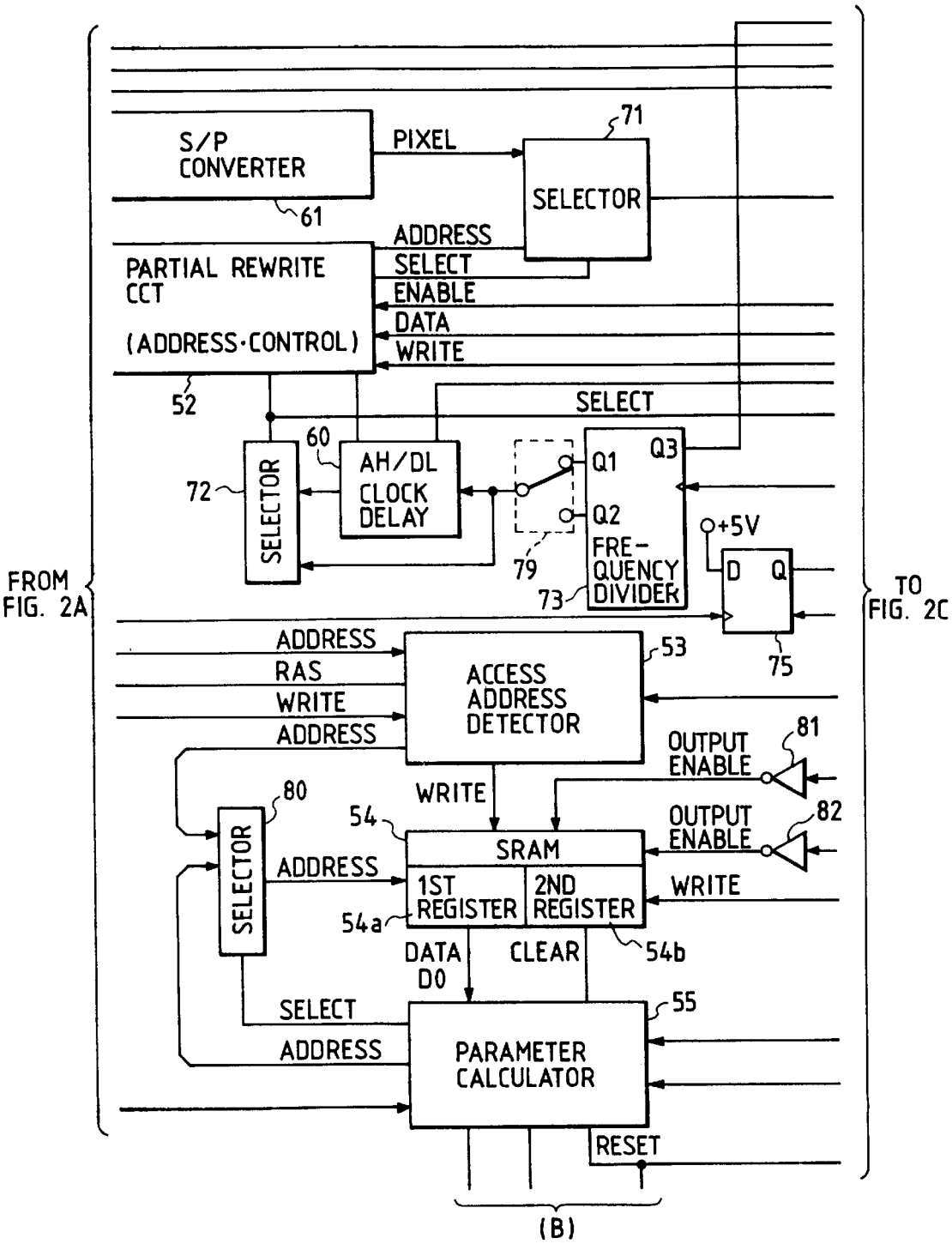
Figure 2C:
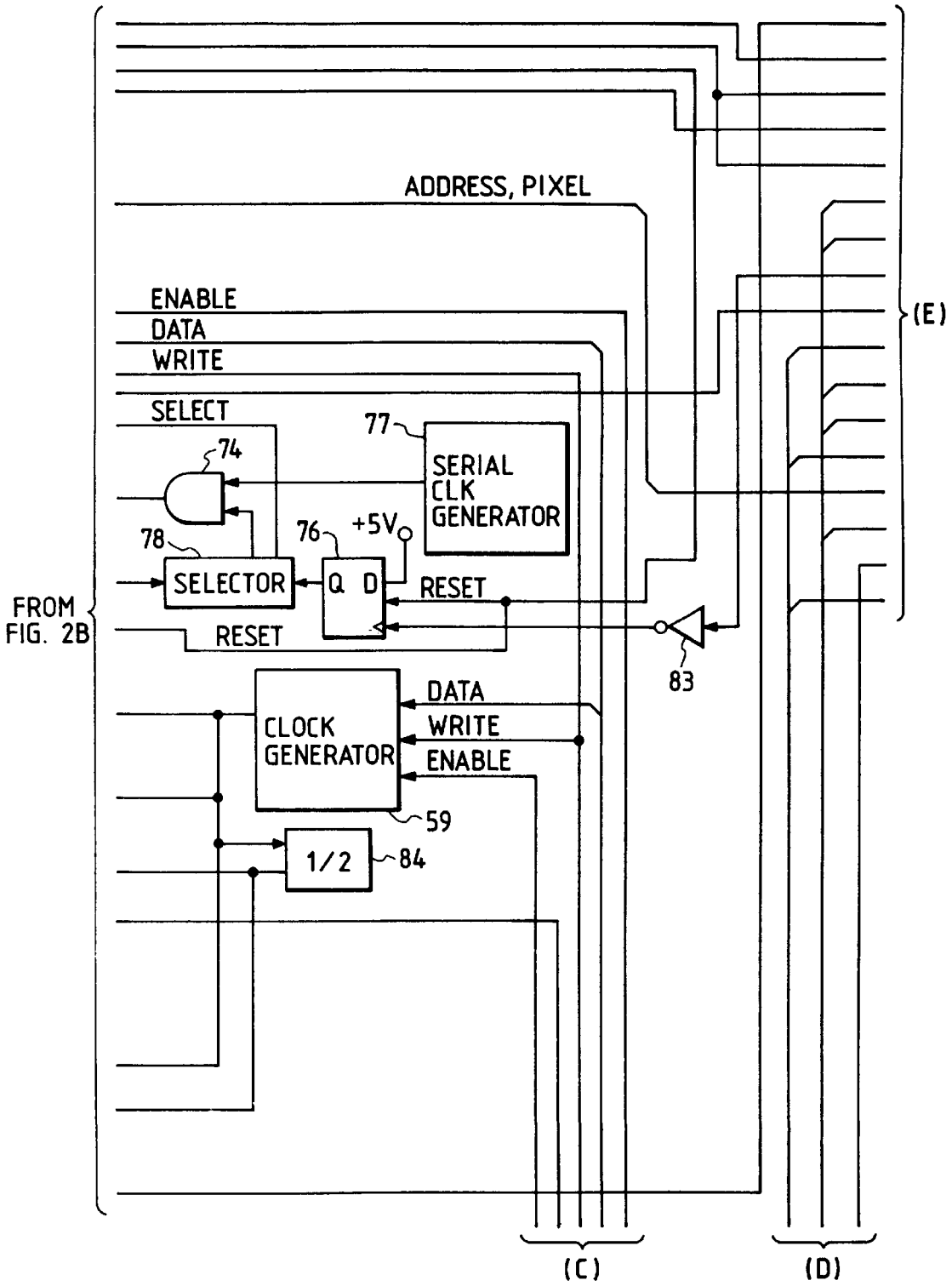
Figure 3:
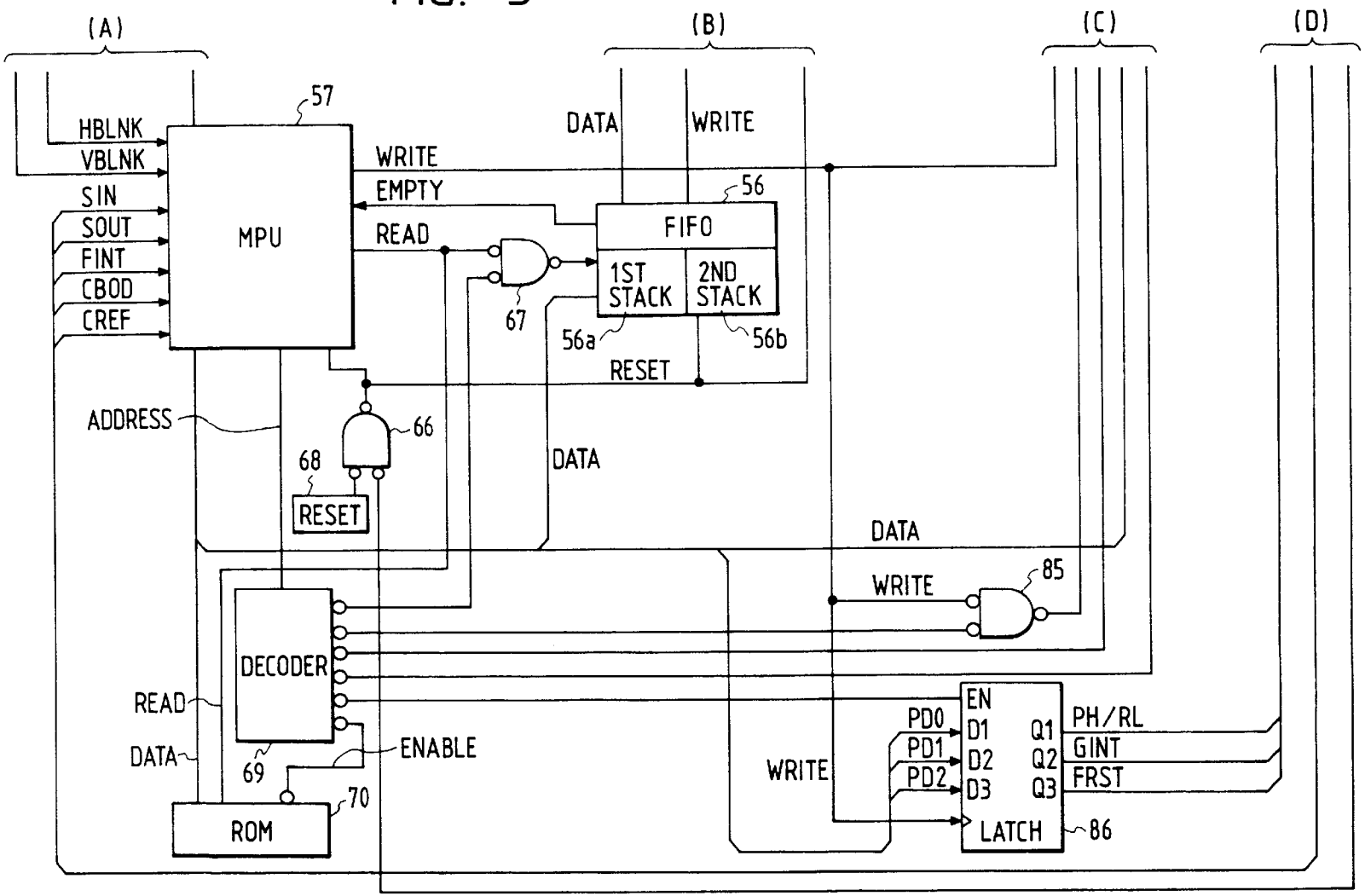
FIG. 3 is a schematic constructional diagram of the display control apparatus of the embodiment of the invention.
Figure 4:
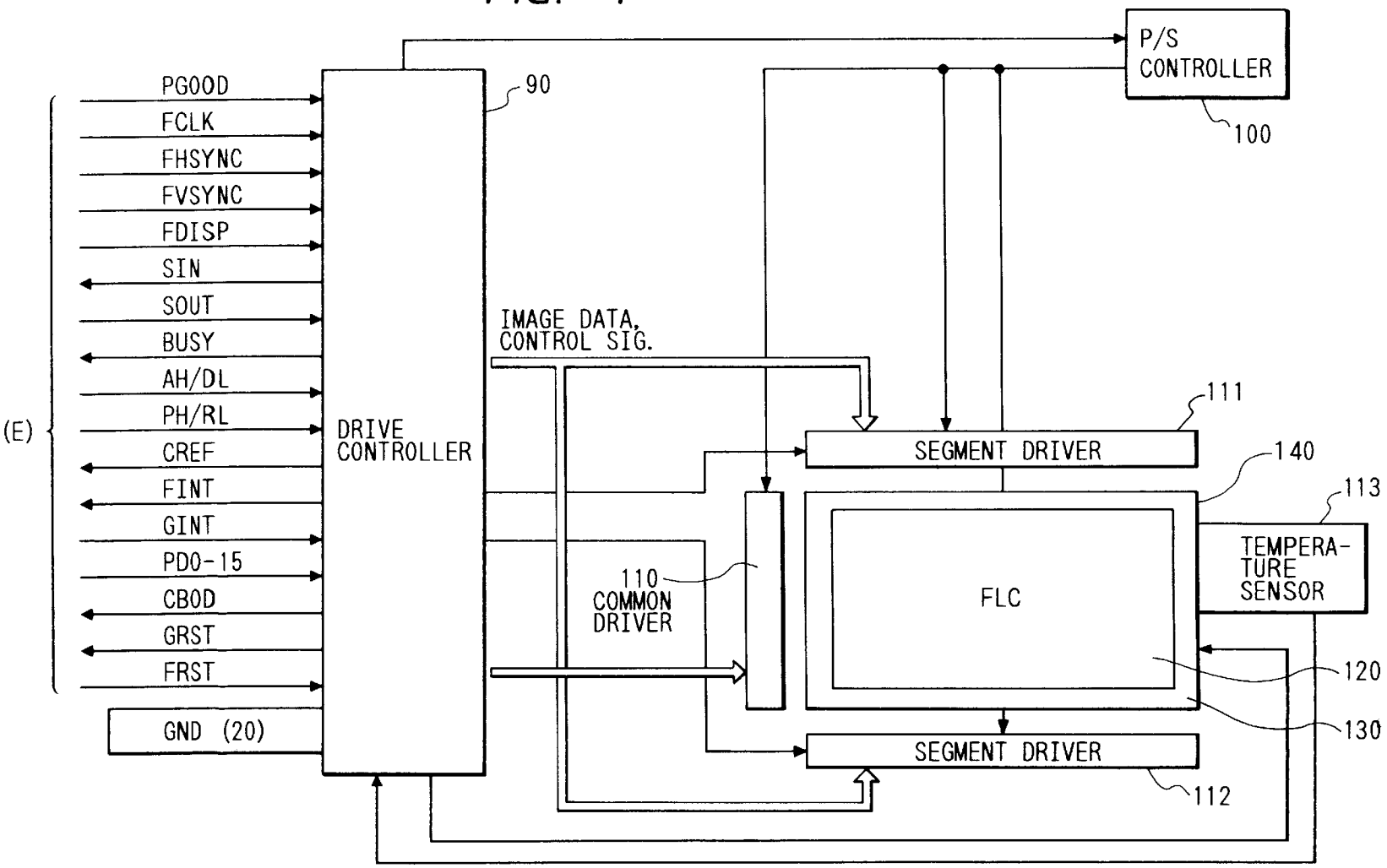
FIG. 4 is a constructional diagram of a liquid crystal display apparatus.

FIG. 4 is a constructional diagram of the LCD 3. (E) in FIG. 4 denotes that it is connected to (E) in FIG. 2, which will be explained hereinbelow. Each symbol shown in the diagram denotes the denomination of a signal line for connecting the display control apparatus 50 and a drive controller 90 (which will be explained hereinlater) of the LCD 3 as shown in FIG. 10. Those signal lines have the functions as shown in FIG. 10.

The LCD 3 shown in FIG. 4 comprises: the drive controller 90; a temperature sensor 113; a common driver 110; segment drivers 111 and 112; a power controller 100; and a display 130.

The drive controller 90 is constructed so that it can correspond to 1024×5120 dots and drives a frame 140, common driver 110, and segment drivers 111 and 112. The drive controller 90 thins out digital image data which is supplied at the same timing as that of the CRT in order to perform the drawing of the multi-interlace on the basis of temperature information from the temperature sensor 113 and, after that, the thinned-out image data is supplied to the common driver 110 and segment drivers 111 and 112.

The temperature sensor 113 is attached at a proper position of the display 130 and supplies the temperature information which is very important in the driving of a ferroelectric liquid crystal (hereinafter, also referred to as an "FLC") to the drive controller 90.

The display 130 comprises the ferroelectric liquid crystal having bistability and is constructed in the following manner. A ferroelectric liquid crystal having a bistable state is sealed in a space between glass plates having transparent electrodes such as ITO or the like connected to two scan line lead-out electrodes and polarizing plates are arranged in a cross nicol. Pixels are constructed by 1024×2560 dots of 1024 scan line electrodes and 2560 information line electrodes. The pixels of the display 130 are driven by an electric field generated by driving waveforms which are supplied to the common driver 110 and segment drivers 111 and 112 and are display by a "light" state or a "dark" state.

The power supply controller 100 properly transforms an input power source on the basis of the signal which is set by the drive controller 90 and supplies the transformed voltages to the common driver 110 and segment drivers 111 and 112.

The segment drivers 111 and 112 and common driver 110 apply the voltages supplied from the power supply controller 100 to each electrode of the display 130.

In the diagram, the display control apparatus 50 is constructed so that it can correspond to 1024×5120 dots. When image data is drawn on the display 130 of the LCD 3 by the multi interlace, the display control apparatus 50 supplies a sync signal, a clock signal, display data, an enable signal, and image data to the drive controller 90 of the LCD 3. On the other hand, when image data is partially rewritten, an external sync signal which is integer times as high as CRT1H synchronized with a horizontal sync signal is supplied from the drive controller 90 at a writing speed of the display 130 or less. A scan line address and image data are supplied to the driver controller 90.

A construction of the display control apparatus 50 will be further explained with reference to FIGS. 2A–C and 3. FIGS. 2A–C and 3 are constructional diagrams of the display control apparatus 50. In FIGS. 2A–C and 3, reference symbols (A), (B), (C), and (D) the manner in which those figures are connected to each other. The display control apparatus 50 shown in FIGS. 2A–C and 3 comprises: a CRT display control section 40 to perform a CRT display control; and a partial rewrite display control section 60 to perform a partial rewrite display control.

Figure 9:
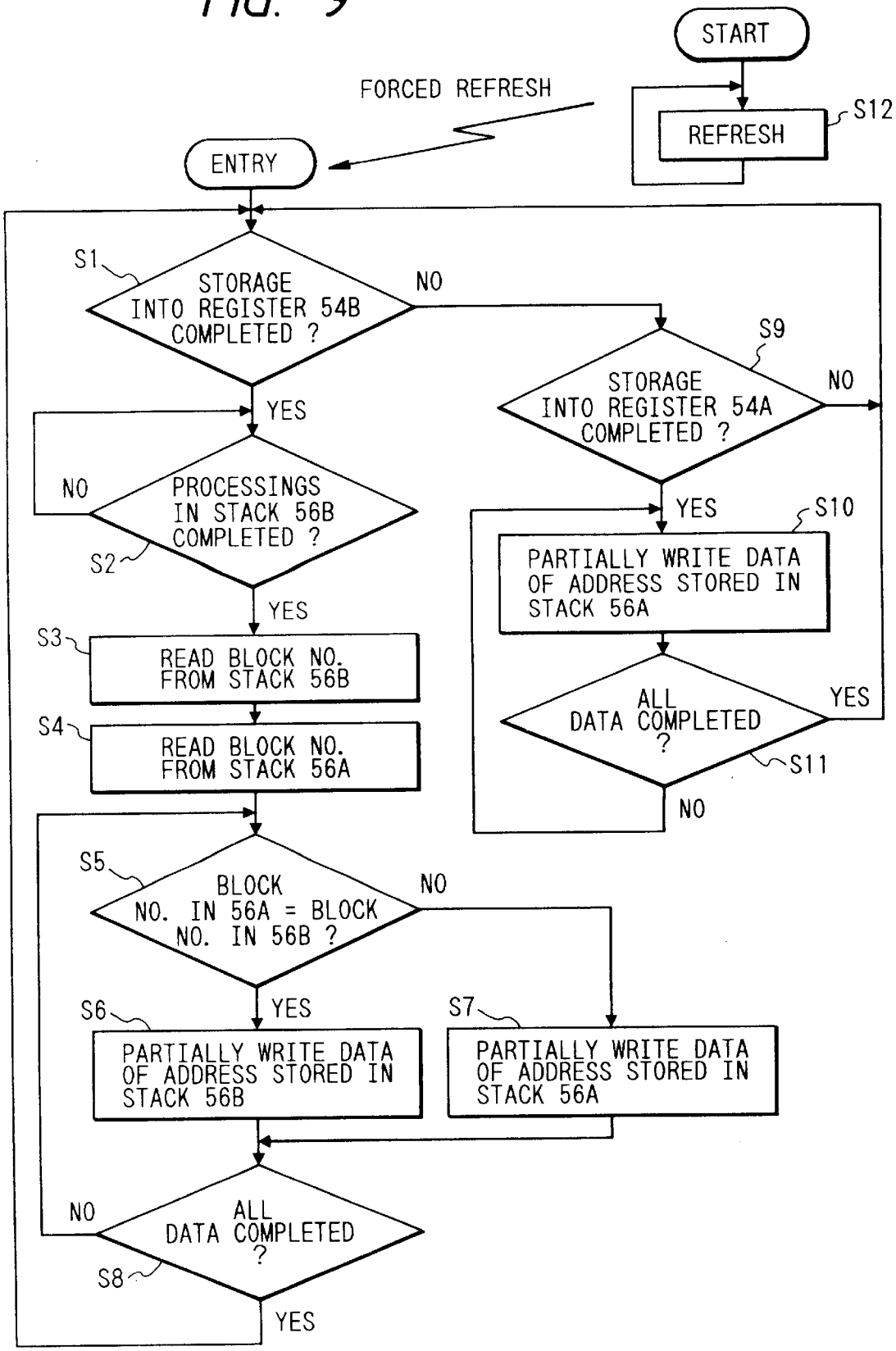
FIG. 9 is a flowchart showing a flow of control of a partial rewrite display control section.

The CRT display control section 40 comprises: an MPU 57 (processing section) to control each section of the display control apparatus 50 in accordance with a control procedure shown in FIG. 9; a VRAM 51 as a video memory which has a serial register and stores the image data generated from the WS 1 through the bus interface 2; the CRTC 58 to generate a CBLNK single, an HBLNK signal, an HSYNC signal, and a VSYNC signal; an S/P converter 61 to convert serial data into pixel data; a tri-state 62; a ½ frequency divider 64; a serial clock generator 77; and a memory ROM 70 to store a control procedure shown in FIG. 9 which is executed by the MPU 57.

The partial rewrite display control section 60 comprises: a partial rewrite circuit 52; an access address detector 53 to discriminate whether the operation to store data into a second register 54*b* of an SRAM 54 has been finished or not; the SRAM 54 which detects the scan address which has been updated from the WS 1 to the VRAM 51 for a predetermined period of time (refer to FIG. 8) and has a first register 54*a* and the second register 54*b* and stores scan address information; a parameter calculator 55 to calculate address information such as block number, start address and the like from the scan address information which has been read out from the second register 54*b* of the SRAM 54 for a predetermined period of time; an FIFO memory 56 which has a first stacker 56*a* and a second stacker 56*b* and functions as an address information memory to store the address information such as block number, start address, and the like; a clock generator 59; and a ½ frequency divider 84.

Figure 5:
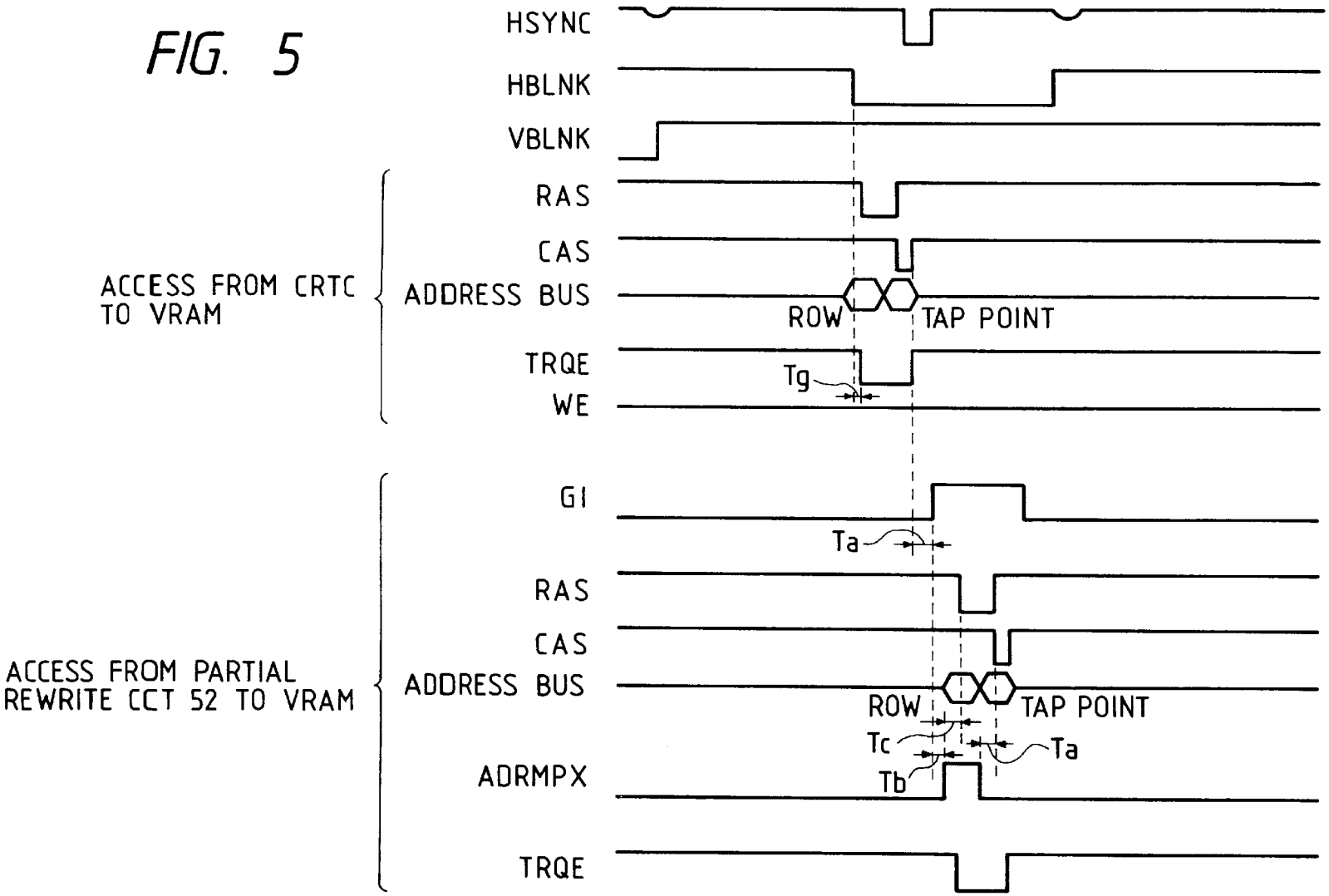
FIG. 5 is a diagram showing a read timing of partial rewrite data in a CRT display period of time.
Figure 6:
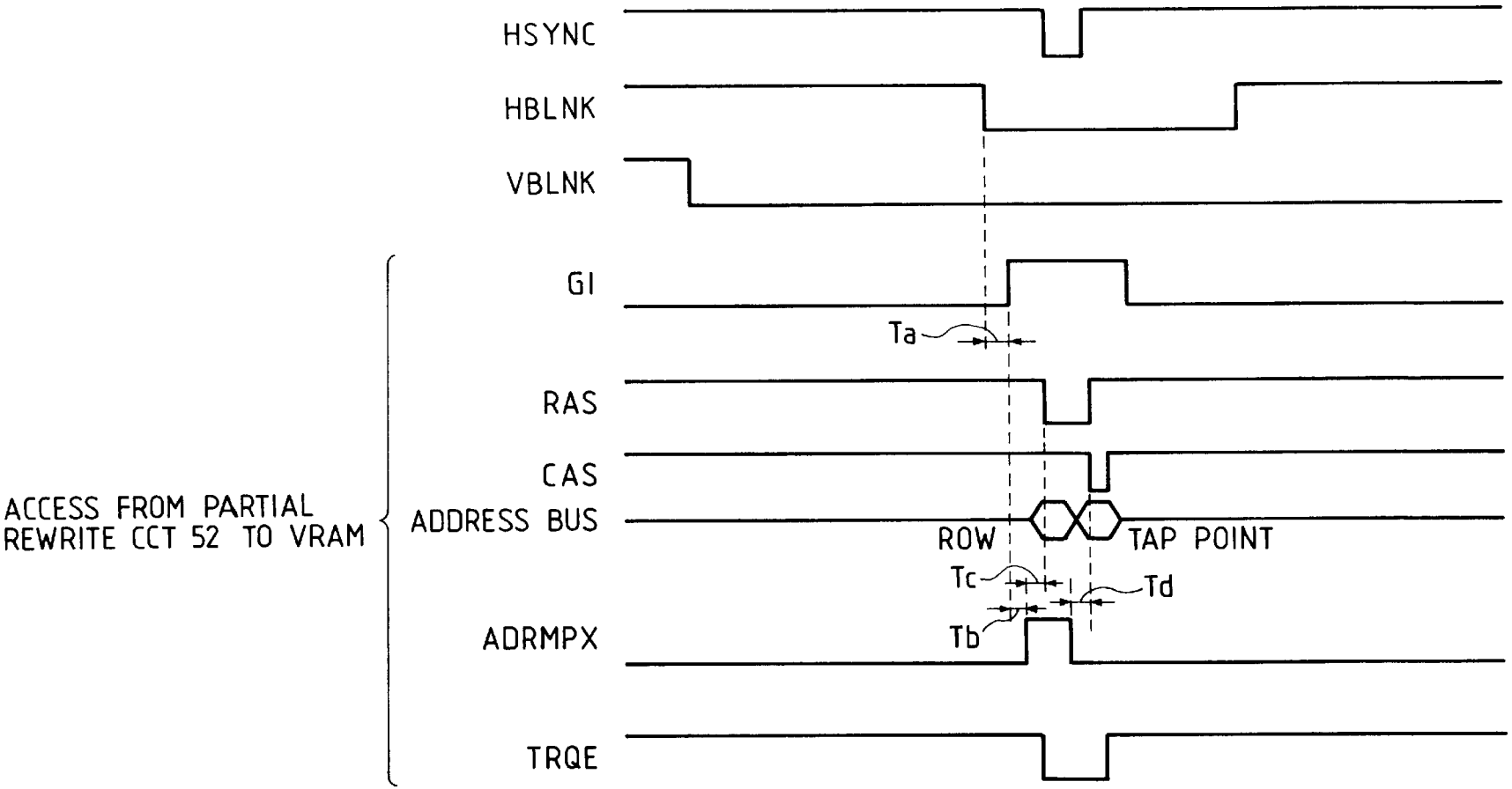
FIG. 6 is a diagram showing a read timing of partial rewrite data in a CRT non-display period of time.

The partial rewrite circuit 52 reads out the partial rewrite image data from the VRAM 51 as shown below. The read timing will now be described with reference to FIGS. 5 and 6. FIG. 5 is a diagram showing a read timing of the partial rewrite data in a CRT display period of time. FIG. 6 is a diagram showing a read timing of the partial rewrite data in a CRT non-display period of time. There are two kinds of reading operations to read out the partial rewrite image data from the VRAM 51. Either one of the two reading operations is determined on the basis of the operating state of the CRTC 58 when the partial rewrite circuit 52 reads out the partial rewrite image data from the VRAM 51.

As shown in FIG. 5, the first operation relates to the reading operation to read out the image data from the VRAM 51 in an effective display period of time in the CRT display, that is, when the vertical blank (VBLNK) signal is set to the high level. In this state, the CRTC 58 controls RAS, CAS, TRQE, WE, and address bus and reads out the image data to refresh the screen from the VRAM 51 when the HBLNK signal is set to the low level. The timing to refresh the screen is shown by parentheses of "ACCESS FROM CRTC TO VRAM" in FIG. 5. After the elapse of time $T_g$ after the HBLNK signal had been set to the low level, the read cycle to the serial register of the VRAM 51 starts. In case of the partial rewriting, after the elapse of time $T_a$ after completion of the read cycle, the reading operation is again executed to the serial register in the VRAM 51. The VRAM read timing of the partial rewrite circuit 52 is shown by parentheses "ACCESS FROM PARTIAL REWRITE CCT 52 TO VRAM" in FIG. 5. The RAS, CAS, TRQE, WE, and address bus are controlled at timings similar to those for the refreshing operation mentioned above. ADRMPX denotes a timing signal to switch a line connection of the address bus by a row address and a tap point. G1 denotes a signal for pending the operation such that the CRTC 58 executes the refreshing operation of the VRAM 51. By the above control, the partial rewrite data can be read out in place of the image data for the ordinary screen refresh operation of the CRTC 58.

As shown in FIG. 6, the second operation is executed for a non-display period of time in the CRT display, namely, when the vertical blank signal is set to the low level. In this state, the CRTC 58 doesn't reads out the image data from the VRAM 51. When the partial rewriting operation is active for such a period of time, after the elapse of time $T_a$ after the HBLNK signal had been set to the low level, the read cycle to the serial register in the VRAM 51 starts. The VRAM read timing by the partial rewrite circuit 52 is shown by parentheses "ACCESS FROM PARTIAL REWRITE CCT TO VRAM" in FIG. 6. The timings of the RAS, CAS, TRQE, WE, and address bus are similar to those in the image data reading operation for the partial rewriting operation in the effective display period of time. ADRMPX denotes the timing signal to switch the line connection of the address bus by the row address and tap point. By the above control, in case of the CRT, the image data can be also supplied to the dipslay. 130 for the vertical blanking period of time during which no data is displayed.

Figure 7:
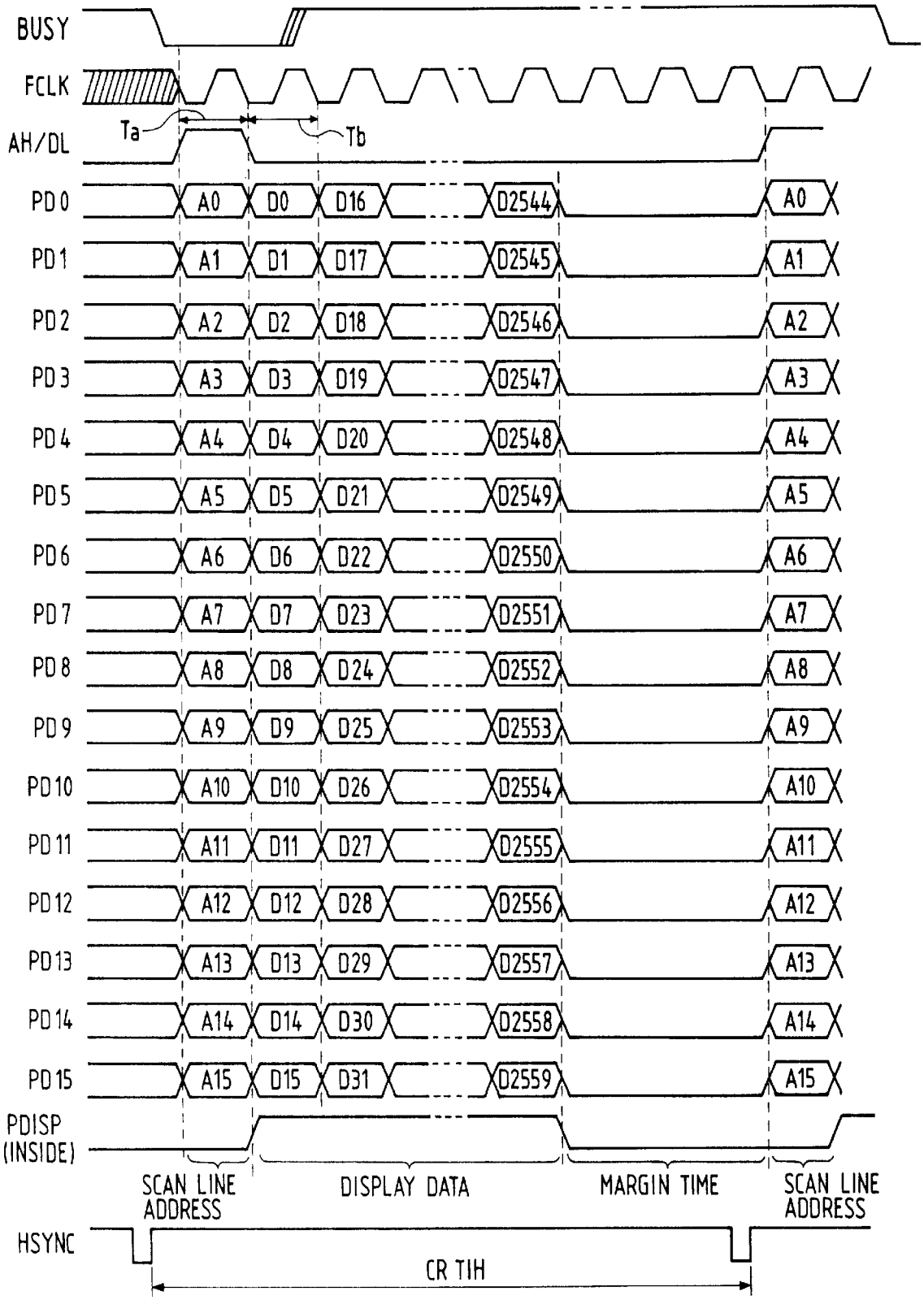
FIG. 7 is a diagram showing an output format of image data in the partial rewriting mode.

In the partial rewriting mode, the partial rewrite circuit 52 generates the image data by an output format shown in FIG. 7. That is, the display 130 is constructed by the pixels of 2560×1024 dots and the image data is shown by D0 to D2559. Scan addresses A0 to A15 of sixteen bits are added to the image data and, after that, the image data is supplied from the display control apparatus 50 to the drive controller 90 by signal lines PD0 to PD15 having a 16-bit width. Those signals are transmitted synchronously with an FCLK signal. A pulse signal of AH/DL is supplied to the drive controller 90 synchronously with the transmission of the head address data A0 to A15. The transmission timing of the image data of one line is synchronized with the HSYNC signal of the CRT.

Figure 8:
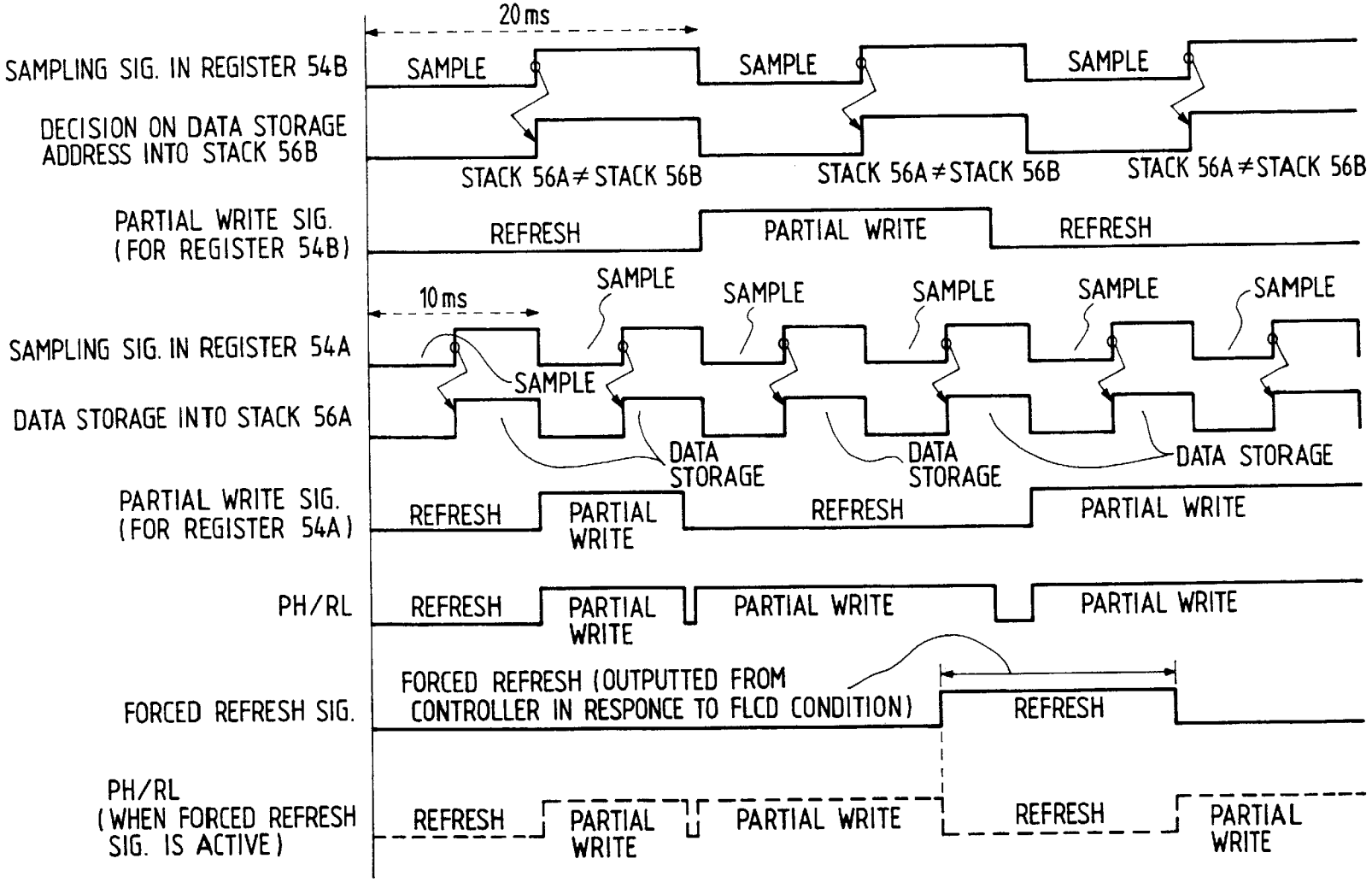
FIG. 8 is a diagram showing a partial rewrite timing.

The operation of the partial rewrite display control section 60 will now be described in accordance with a control flow of FIG. 9 also with reference to a diagram showing the partial rewrite timing of FIG. 8.

The access address detector 53 detects the scan address which has been updated from the WS 1 to the VRAM 51 (refer to FIG. 8) and a check is made to see if the operation to store the image data into the second register 54*b* of the SRAM 54 has been finished or not (step S1). If YES, step S2 follows. If NO, the processing routine advances to step S9, which will be explained hereinlater.

A processing in step S2 is executed by the following procedure. First, the SRAM 54 performs a flag access to set "1" into the updating address, so that the access of the same address is convolved and stored. For the high-level period of time of the signal of the ½ frequency divider 84, the parameter calculator 55 reads out the scan address information stored in the second register 54*b* of the SRAM 54. Subsequently, the parameter calculator 55 calculates the block number, start address, end address, line number, and total line number from the scan address information and writes into the second stacker 56*b* of the FIFO memory 56. In step S2, a check is made to see if the above operation has been completed or not.

When a predetermined operation is finished in step S2, the MPU 57 reads out the block number calculated by the parameter calculator 55 from the second stacker 56*b* in the FIFO memory 56 (S3). The MPU 57 subsequently reads out the block number calculated by the parameter calculator 55 from the first stacker 56*a* in the FIFO memory 56 (S4). A difference between the numbers of addresses stored in the stackers 56*a* and 56*b* can be known by comparing the block numbers in the first and second stackers 56*a* and 56*b* which have been read out by the MPU 57 in steps S3 and S4 (S5).

If YES in step S5, step S6 is executed in accordance with the following procedure. First, the MPU 57 sets the PH/RL signal line to the high level and instructs the drive controller 90 to write. Subsequently, the drive controller 90 sets a BUSY signal line to the low level at the timing synchronized with the horizontal sync signal at the liquid crystal response speed of the display 130 or less and requests the scan line address information and the image data to the display control apparatus 50. The partial rewrite circuit 52 reads out the partial rewrite image data from the VRAM 51. The above operation is determined by the operating state of the CRTC 58 and differs in dependence on a mode for the effective display period of time in the CRT display, namely, when the vertical blank signal is at the high level and a mode for the non-display period of time, namely, when the vertical blank signal is at the low level. The level of the vertical blank signal is judged from the CBLNK signal which is supplied from the CRTC 58. When the vertical blanking period of time of the CBLNK signal supplied from the CRTC 58 is at the high level, namely, in case of the effective display period of time of the CRT, the CRTC 58 reads out the image data of one line from the VRAM 51 to the serial register in the VRAM 51 for the horizontal blanking period of time for the CRT display. After completion of the above operation, the partial rewrite circuit 52 disables the tri-state 62 and supplies the address information indicative of the partial rewrite data to the VRAM 51, thereby newly reading out the image data to the serial register in the VRAM 51. When the vertical blanking period of time of the CBLNK signal supplied from the CRTC 58 is at the low level, the partial rewrite circuit 52 disables the tri-state 62 for the horizontal non-display period of time on the basis of the HBLNK signal which is supplied from the CRTC 58 and supplies the address information indicative of the partial rewrite data to the VRAM 51, thereby reading out the image data to the serial register in the VRAM 51. The image data read out to the serial register in the VRAM 51 is read out every eight pixels (two bits/pixel) by the serial clock generator 77 by using the scan line address which is supplied from the MPU 57 as a head address. The read image data is supplied to the drive controller 9. By the above operation, the content of the address information detected by the first register 54*a* in the SRAM 54 is drawn on the display 130.

If NO in step S5, step S7 is executed in accordance with the following procedure in a manner similar to step S6 mentioned above except a different point such that the content of the address information detected in the second register 54*b* in the SRAM 54 is drawn on the display 130 by the above operation.

A check is made to see if the contents of all of the address information detected in the registers 54*a* and 54*b* in the SRAM 54 have been drawn by the display 130 or not (S8). If NO in step S8, the processing loop in steps S5, S6, and S8 or the processing loop in steps S5, S7, and S8 is repeated until the contents of all of the address information are displayed. After the contents of all of the address information were displayed on the display 130, the processing routine is returned to step S1.

If NO in step S1, that is, when the sampling of the data in the second register 54*b* is not finished yet, a check is made to see if the sampling of the data in the first register 54*a* has been finished or not (S9). If NO in step S9, the processing routine is returned to step S1. If YES, a processing in step S10 is executed.

The processing in step S10 is executed in accordance with a procedure similar to step S6 mentioned above. By the operation in step S10, the content of the address information detected in the second register 54*b* in the SRAM 54 is drawn on the display 130.

A check is made to see if the contents of all of the address information detected in the first register 54*a* in the SRAM 54 have been drawn on the display 130 or not (S11). If NO in step S11, a processing loop in steps S10 and S11 is repeated until the contents of all of the address information are displayed. After the contents of all of the address information were displayed on the display 130, the processing routine is returned to step S1.

A CREF signal is supplied from the drive controller 90 to the MPU 57 as an exceptional processing of the forced refresh. The CREF signal is a signal to forcedly refresh the screen by the multi interlace because in the case where the partial writing operation to the display 130 is continued, the contrast of the scan line which is not accessed rises (S12). When the CREF signal is supplied, the display control apparatus 50 sets the PH/RL signal to the low level and supplies the image data to the drive controller 90 at the display timing of the CRT. The partial rewrite display control is executed as mentioned above.

According to the display control apparatus 50 of the embodiment with the above construction, the following effects are obtained.

(a) Since the multi interlace drawing is used, the flickerless display can be performed in the high precision display.

(b) For a drawing object which moves at a high speed, by using a partial rewriting method of partially rewriting the screen by the non-interlace, a flicker of the display of an animation image by the high-order interlace can be prevented.

(c) By using the (video memory) and the screen refresh function which the conventional CRT display control apparatus has without changing and by adding the partial rewriting function, the image data writing operation of the WS (host computer) 1, the refreshing operation of the VRAM 51, and the video data reading-out operation for reading out and rewriting the video data of the CRT are executed by the arbitration of the VRAM 51. Therefore, the timing of the image data which is supplied to the LCD 3 coincides with the display timing of the CRT. The display control apparatus 50 when it is seen from the WS (host computer) 1 side is equivalent to the conventional CRT display control apparatus. Therefore, there is no need to use any special software driver for the LCD 3 and the software driver of the conventional CRD display control apparatus can be used as it is.

(d) In case of the conventional CRT display control apparatus, no image data is drawn in the vertical blanking period, namely, in a beam blanking period of time. However, in the vertical blanking period as well, since the image data is read out from the VRAM 51 synchronously with the horizontal blank signal, the image data can be smoothly drawn on the LCD 3.

The above invention is not limited to the foregoing embodiments but many modifications and variations are possible within the spirit and scope of the appended claims of the invention.

According to the present invention described in detail above, the data indicative of the display position of the rewritten portion is added to the image data and sync signal of the portion which has been rewritten by the host computer by the non-interlace, and after that, the resultant image data is supplied to the LCD at the timing synchronized with the display to the cold CRT. Therefore, even in the case where the display speed in the high precision display of the LCD is insufficient to perform the flickerless display in the non-interlace drawing, the display control apparatus which can perform the flickerless display at a high precision without changing a construction of the electrodes or the like of the display apparatus can be provided.

According to the present invention, in addition to the effects disclosed in claim 1, the data indicative of the display position of the rewritten portion, the image data, and the sync signal can be supplied to the LCD for the drawing period of time of the effective display region of the cold CRT and for the vertical blanking period, so that the image data can be smoothly drawn on the LCD.

What is claimed is:

1. A display control apparatus comprising:

memory means for storing image data, supplied from a host computer, at a designated address in said memory means, the image data being for display by display means;

calculation means for calculating a calculated address indicating a scanning line of the display means from the designated address;

first sampling means for sampling the calculated address at predetermined first time intervals to provide a first sampled address at each first time interval;

second sampling means for sampling the calculated address at predetermined second time intervals to provide a second sampled address at each second time interval, the second time interval being different from the first time interval;

comparison means for comparing the first sampled address and the second sampled address concurrently available to provide a selected sampled address;

reading means for reading, from said memory means, one line of image data corresponding to the selected sampled address;

grouping means for grouping together the image data read by said reading means and the calculated address calculated by said calculation means;

output means for outputting the data grouped together by said grouping means to the display means; and display control means for controlling the display means to display the read image data based on the calculated address.

2. An apparatus according to claim 1, further comprising switching means for switching between a partial rewrite reading mode to read out the image data stored in a continuous region of said memory means and a total reading mode to sequentially read out the image data from a position of said memory means corresponding to a display start position of said display means, and wherein said grouping means operates in the event that said apparatus is set in the partial rewrite reading mode.

3. An apparatus according to claim 1, wherein said display means includes a liquid crystal display apparatus.

4. An apparatus according to claim 3, further comprising switching means for switching between a partial rewrite reading mode to read out the image data stored in a continuous region of said memory means and a total reading mode to sequentially read out the image data from a position of said memory means corresponding to a display start position of said display means, and wherein said grouping means operates in the event that said apparatus is set in the partial rewrite reading mode.

5. A display control apparatus for storing image data supplied from a host computer into memory means and for displaying the image data in a display apparatus, comprising:

memory means for storing the image data;

detecting means for detecting a portion of the stored image data that has been rewritten by the host computer in a non-interlace manner;

calculation means for calculating a calculated address indicating a scanning line of the display apparatus from an address of the portion detected by said detecting means;

first sampling means for sampling the calculated address at predetermined first time intervals to provide a first sampled address at each first time interval;

second sampling means for sampling the calculated address at predetermined second time intervals to provide a second sampled address at each second time interval, the second time interval being different from the first time interval;

comparison means for comparing the first sampled address and the second sampled address concurrently available to provide a selected sampled address;

reading means for reading, from the memory means, one line of image data corresponding to the selected sampled address;

grouping means for grouping the image data of the detected portion and the address calculated by said calculation means; and display control means for controlling the display apparatus to display the image data on the basis of the data grouped together by said grouping means.

6. An apparatus according to claim 5, wherein said display means includes a liquid crystal display apparatus.

7. An apparatus according to claim 6, wherein said display control means displays on the basis of a sync signal for a CRT display apparatus.

8. An apparatus according to claim 7, wherein said display control means displays the image data for a drawing period of time of an effective display region for a CRT display apparatus and for a blanking period of time of a vertical sync signal.

9. An apparatus according to claim 5, further comprising switching means for switching between a partial rewrite reading mode to read out the image data stored in a continuous region of said memory means and a total reading mode to sequentially read out the image data from a position of said memory means corresponding to a display start position of the display means, and wherein said grouping means operates in the event that said apparatus is set in the partial rewrite reading mode.

10. A display control method for storing image data supplied from a host computer into memory means and for displaying the image data in a display apparatus, comprising the steps of:

storing the image data into the memory means;

detecting a portion of the stored image data that has been rewritten by the host computer in a non-interlace manner;

calculating a calculated address indicating a scanning line of the display apparatus from an address of the detected portion;

sampling the calculated address at predetermined first time intervals to provide a first sampled address at each first time interval;

sampling the calculated address at predetermined second time intervals to provide a second sampled address at each second time interval, the second time interval being different from the first time interval;

comparing the first sampled address and the second sampled address concurrently available to provide a selected sampled address;

reading, from the memory means, one line of image data corresponding to the selected sampled address calculated at said calculating step;

grouping the image data of the detected portion with the calculated address; and controlling the display apparatus to display the image data on the basis of the grouped data.

11. A display control apparatus comprising:

memory means for storing supplied image data, the image data being for display by display means;

detecting means for detecting addresses, in said memory means, at which the supplied image data are stored;

calculation means for calculating calculated addresses indicating scanning lines of the display means from the addresses detected by said detecting means;

first sampling means for sampling the calculated addresses at predetermined first time intervals to provide a first sampled address at each first time interval;

second sampling means for sampling the calculated addresses at predetermined second time intervals to provide a second sampled address at each second time interval, the second time interval being different from the first time interval;

comparison means for comparing the first sampled address and the second sampled address concurrently available to provide a selected sampled address;

reading means for reading, from said memory means, one line of image corresponding to the selected sampled address;

obtaining means for obtaining display information on the basis of the first and second sampled addresses;

grouping means for grouping the image data stored in said memory means together with one or more of the calculated addresses and the display information obtained by said obtaining means;

supply means for supplying the grouped data to a display means; and control means for controlling the display means to display the supplied image data on the basis of the supplied display information.

12. An apparatus according to claim 11, wherein the display information includes a start address and the number of addresses.

13. An apparatus according to claim 11, wherein the display means comprises a ferroelectric liquid crystal display.

14. An apparatus according to claim 11, further comprising image data supply means for supplying the image data and wherein said memory means stores the image data supplied by said image data supply means.

15. A method on a display control apparatus comprising:

a first storing step of storing supplied image data;

a detecting step of detecting addresses, in a memory means, at which the supplied image data are stored;

a calculating step of calculating addresses indicating scanning lines of a display means from the detected addresses;

a first sampling step of sampling the calculated addresses at predetermined first time intervals to provide a first sampled address at each first time interval;

a second sampling step of sampling the calculated addresses at predetermined second time intervals to provide a second sampled address at each second time interval, the second time interval being different from the first time interval;

a comparison step of comparing the first sampled address and the second sampled address concurrently available to provide a selected sampled address;

a reading step of reading, from the memory means, one line of image data corresponding to the selected sampling address;

an obtaining step of obtaining display information on the basis of the first and second sampled addresses;

a grouping step of grouping the image data stored in the memory means together with one or more of the calculated addresses and the display information obtained at said obtaining step;

a supplying step of supplying the grouped data to the display means; and a controlling step of controlling the display means to display the supplied image data on the basis of the supplied display information.

16. A method according to claim 15, wherein the display information includes a start address and the number of addresses.

17. A method according to claim 15, wherein the display means comprises a ferroelectric liquid crystal display.

18. A method according to claim 15, further comprising a second supplying step of supplying the image data and wherein the memory means stores the image data supplied by an image data means.

* * * * *

UNITED STATES PATENT AND TRADEMARK OFFICE

CERTIFICATE OF CORRECTION

PATENT NO. : 5,905,483

DATED : May 18, 1999

INVENTOR(S) : OSAMU YUKI

It is certified that error appears in the above-identified patent and that said Letters Patent is hereby corrected as shown below:

COLUMN 1 line 34, "flicking," should read --flickering,--; and
line 60, "it is" should be deleted.

COLUMN 2 line 4, "display" should read --displayed--.

COLUMN 3 line 59, "display" should read --displayed--.

COLUMN 4 line, 47 "an" should read --a--.

UNITED STATES PATENT AND TRADEMARK OFFICE

CERTIFICATE OF CORRECTION

PATENT NO. : 5,905,483

DATED : May 18,1999

INVENTOR(S) : OSAMU YUKI

It is certified that error appears in the above-identified patent and that said Letters Patent is hereby corrected as shown below:

COLUMN 5 line 26, "doesn't reads" should read --does not read--; and
line 40, "dipslay." should read --display.--.

Signed and Sealed this

Eighteenth Day of January, 2000

*Attest:*

Q. TODD DICKINSON

*Attesting Officer*

*Commissioner of Patents and Trademarks*

UNITED STATES PATENT AND TRADEMARK OFFICE

CERTIFICATE OF CORRECTION

PATENT NO. : 5,905,483

DATED : May 18, 1999

INVENTOR(S) : OSAMU YUKI

It is certified that error appears in the above-identified patent and that said Letters Patent is hereby corrected as shown below:

ON THE COVER PAGE AT [*] NOTICE

Insert: --This patent issued on a continued prosecution application filed under 37 CFR 1.53(d), and is subject to the twenty year patent term provisions of 35 U.S.C. 154(a)(2).--.

Signed and Sealed this

Sixth Day of June, 2000

*Attest:*

Q. TODD DICKINSON

*Attesting Officer*

*Director of Patents and Trademarks*